US012673795B2

(12) United States Patent
Montañà Caelles et al.

(10) Patent No.: US 12,673,795 B2
(45) Date of Patent: Jul. 7, 2026

(54) POUCH MAGAZINE AND A METHOD TO SEQUENTIALLY SUPPLY EMPTY POUCHES TO A PACKAGING MACHINE

(71) Applicant: VOLPAK, S.A.U., Santa Perpetua de Mogoda (ES)

(72) Inventors: Xavier Montañà Caelles, Santa Perpetua de Mogoda (ES); Albert Grau Calvó, Santa Perpetua de Mogoda (ES)

(73) Assignee: VOLPAK, S.A.U., Santa Perpetua de Mogoda (ES)

( * ) Notice: Subject to any disclaimer, the term of this patent is extended or adjusted under 35 U.S.C. 154(b) by 0 days.

(21) Appl. No.: 18/653,521

(22) Filed: May 2, 2024

(65) Prior Publication Data

US 2024/0367838 A1 Nov. 7, 2024

(30) Foreign Application Priority Data

May 3, 2023 (IT) ..... 102023000008760

(51) Int. Cl.
*B65B 43/14* (2006.01)
*B65H 3/08* (2006.01)

(52) U.S. Cl.
CPC ..... *B65B 43/14* (2013.01); *B65H 3/08* (2013.01)

(58) Field of Classification Search
CPC ..... B65B 43/14; B65H 3/08
See application file for complete search history.

(56) References Cited

U.S. PATENT DOCUMENTS 2,805,898 A * 9/1957 Willis, Jr. ..... B65G 51/03 406/88
3,773,391 A * 11/1973 Crandall ..... B65G 51/03 406/88
3,918,706 A * 11/1975 Craft ..... B65H 5/228 406/87
4,081,201 A * 3/1978 Hassan ..... B65G 51/03 406/88
4,186,860 A * 2/1980 Reba ..... B65H 23/24 226/7
4,288,015 A * 9/1981 Curtin ..... B65H 23/32 242/615.12

(Continued)

OTHER PUBLICATIONS

Search Report dated Dec. 21, 20213 in Italian Application No. 202300008760.

*Primary Examiner* — Shelley M Self
*Assistant Examiner* — David G Shutty
(74) *Attorney, Agent, or Firm* — Sughrue Mion, PLLC

(57) ABSTRACT

A pouch magazine that comprises a rack to accommodate a stack of empty pouches and a pouch pick up area having a positioning stopper, the magazine having a pouch separating means configured to separate the first pouch from the stack enabling sending it to the pouch pick up area, wherein the pouch magazine is equipped with a pouch conveyor to convey the separated pouch of the stack up to the positioning stopper of the pick up area, the said pouch conveyor having means for supplying a stream of pressurized fluid upon which the conveyed separated pouch lies, said means for supplying a stream being configured to applying sufficient Coanda effect forces to said stream to propel the separated pouch to the pick up area and to maintain the separated pouch against the positioning stopper of the pick up area.

9 Claims, 2 Drawing Sheets

(56) References Cited

U.S. PATENT DOCUMENTS

| | | | | | |
|---|---|---|---|---|---|
| 4,342,413 | A * | 8/1982 | Reba | B65H 23/24 | 226/7 |
| 4,453,709 | A * | 6/1984 | Reba | B65H 5/228 | 226/7 |
| 5,645,274 | A * | 7/1997 | Ubayashi | B65H 3/128 | 271/265.04 |
| 6,361,041 | B2 * | 3/2002 | Stephan | B65H 29/52 | 406/88 |
| 7,513,716 | B2 * | 4/2009 | Hayashi | B65G 51/03 | 406/87 |
| 8,122,692 | B2 * | 2/2012 | Inoue | B65B 43/14 | 53/386.1 |
| 9,022,719 | B2 * | 5/2015 | Yoshikane | B65B 43/14 | 414/796.4 |
| 9,598,192 | B2 * | 3/2017 | Yoshikane | B65B 3/045 | |
| 9,926,143 | B2 * | 3/2018 | Yoshikane | B65G 47/915 | |
| 2005/0067754 | A1 * | 3/2005 | Shigenaga | B65H 3/0816 | 271/30.1 |
| 2008/0061493 | A1 * | 3/2008 | Weaver | B65H 3/48 | 271/94 |

* cited by examiner

POUCH MAGAZINE AND A METHOD TO SEQUENTIALLY SUPPLY EMPTY POUCHES TO A PACKAGING MACHINE

TECHNICAL FIELD OF THE INVENTION

The invention belongs to the field of pouch magazines. Particularly, it is directed to a pouch magazine prepared to sequentially supply empty pouches to a packaging machine.

BACKGROUND OF THE INVENTION

Packaging machines are conventionally equipped with means to transport containers along successive stations wherein the containers are opened, filled and sealed. Other operations can be performed over the transported containers depending on the type of container and the nature of the product or products to be stored therein.

One type of packaging machines is of those that procure packaging in pouches. We refer to pouches as flexible containers mainly made from film material that, when empty, can adopt a flat configuration. There are, without being limited to, flat pouches, box bottom pouches and Stand-up pouches, to name some.

It is known to supply already made but empty pouches to packaging machines, the pouches being prepared or being able to the filled and sealed in the packaging machine. In the relevant art they are referred to as premade pouches.

Conventionally, a batch of pre-made pouches are loaded in a magazine and the magazine is equipped with means to enable an accurate supply of individual pouches to the packaging machine. For that purpose, the magazines are provided with means to push and drag a first pouch of the batch to a pick up area of the magazine from where movable transfer means, in a reciprocating motion, takes the pouch, transports and delivers it to the packaging machine and moves back to take a new pouch to be delivered to the packaging machine.

The current cadence of some packaging machines is so high that this transition from the batch to the pick up area has to be very fast.

The means to push and drag a first pouch of the batch to the pick up area also must ensure the correct positioning of the pouch in this pick up area. Sometimes magazines have means to correct deviations of a target position, but this makes magazines more complex, makes them more expensive and can affect the supply regime of pouches.

With regard to the positioning of the pouch in the pick up area, it is known to use pushers in the form of fingers, shovels, ribbons, ratchet wheels or mobile brushes that exert pressure by contact on a free upper face of the pouch and accompany it in movement, dragging them on a plate, until it is arranged in the pick up area. The space occupied by these pushers can interfere with the trajectory of the movable transfer means. If these pushers are dimensioned or configured so that their movement does not interfere with the trajectory of the movable transfer means, especially when the movable transfer means approach the pouch they must collect arranged in the pick up area, it may happen that for small, namely short, pouches these pushers stop contacting the tail of the pouch, that is, they cannot accompany it until they reach the pick up area. Therefore, the pushers are in the necessity of throwing the pouch, conferring to it an enough inertia so that the pouch reach by itself the pick up area. However, this can produce a bounce of the pouches when they reach the end of the stroke of the plate, where there is a stopper, negatively affecting their correct positioning.

It is a first objective of the present invention to provide an alternative solution to the known magazines.

It is another objective of the present invention to provide a simpler magazine, without renouncing to be able to arrange pouches in the pick up area in a fast way, matching with the high production cadences of the packaging machines, and without renouncing either to the pouch be correctly positioned in the aforementioned pick up area, without deviations or with minor deviations that can be corrected in a simple way downstream of the process.

It is also an objective of the present invention a more versatile magazine, that allows to operate with pouches of different format, with a wide range of format not only in a dimension of width of the pouch but also in a dimension of length that is the one that poses problems of using conventional pushers.

It is also an objective of the invention, a magazine that is compatible with other solutions aimed at correcting other existing problems. By way of example, it is desirable that the magazine of the invention is easily compatible with solutions intended to be able to supply pouches with or without spout. Indeed, it may happen that conventional pushers that work for simple pouches must be adapted or replaced to operate with pouches with spout.

DESCRIPTION OF THE INVENTION

With the aim of finding an alternative to the known pouch magazines, a pouch magazine to sequentially supply empty pouches to a packaging machine according to claim 1 is disclosed.

The pouch magazine comprises a rack to accommodate a stack of empty pouches, a pouch pick up area having a positioning stopper and a pouch separating means configured to separate the first pouch from the stack enabling sending it to the said pouch pick up area.

The pouch magazine is essentially characterized in that it is equipped with a pouch conveyor to convey the separated pouch of the stack up to the positioning stopper of the pick up area, the said pouch conveyor having means for supplying a stream of pressurized fluid upon which the conveyed separated pouch lies, said means for supplying a stream being configured to applying sufficient Coanda effect forces to said stream to propel the separated pouch to the pick up area and to maintain the separated pouch against the positioning stopper of the pick up area.

Instead of opting for mechanical conveyors, the invention opts for employing the Coanda effect to propel separated empty pouches to a pick up area of the magazine. Advantageously, employing the Coanda effect not only gives rise to a fast and effective transport, according to the high cadence of the packaging machines, but also guarantees the correct positioning of the separated pouch because not only the pouch is conveyed but once it reaches the positioning stopper the same effect Coanda maintains the pouch against the said positioning stopper.

Advantageously, this transport solution leaves the top face of the pouch placed in the pick up area free. Consequently, this area above the pouch is cleared and the problems of mechanical interference with the transfer means, that conventionally take the pouch, transports and delivers it to the packaging machine, disappear.

Advantageously also, this transport solution ensures correct positioning while preventing undue distortion or folding of the separated pouch. Indeed, the Coanda effect not only seeks to propel the separated pouch but also seeks a suction effect against the support provided below the separated pouch in the area of influence of the Coanda effect, as it will be explained in more detail later.

Contrary to what might be expected, this suction effect does not prevent the transfer means from easily removing the pouch from the pick up area, even if these transfer means are of the type that use suction elements.

In the present case, the stream of pressurized fluid is easily controllable in quantity and in pressure, normally low relative to atmospheric pressure, to procure the Coanda effect in accordance with Bernoulli's principle.

As it will be further developed, in combination with pouches with essentially parallel side edges, this principle may be applied to propel the pouch from at least one of its side edges, preferably at least from its two opposite side edges and can also be easily adapted to various formats of pouch, as far as its dimension in width is concerned.

In the present disclosure, the terms "a" and "one" are used herein to refer to one or more than one (i.e., to at least one) of the grammatical object of the term. By way of example, "a rack" means one or more racks.

Throughout the specification, the term "comprises", or variations such as "comprising" or "comprising of", a certain element or action, will be understood to imply the inclusion of these, but not the exclusion of any other element or action.

In one embodiment, a pick up area is longitudinally aligned with a rack.

In other embodiment the pick up area is not longitudinally aligned with the rack storing the pouches fed to the pick up area, so that the separated pouch is conveyed to the pick up area following a path not entirely straight.

In an embodiment, the pouch conveyor extends all along the pick up area.

The pouch conveyor can extend all along the pick up area and up to the rack storing the pouches fed to the pick up area.

In an embodiment, the pouch conveyor comprises a first and a second, elongated, plates defining respective slip surfaces with jet nozzles to project the pressurized fluid that propels the separated pouch. These plates are meant to propel the pouch from respective areas of the pouch next to or including opposite lateral edges of the same.

This provision takes advantage of the fact that certain pouches, on their opposite lateral side edges, can be flatter than in other areas due to the effect produced by the sealing seams on said edges, or in the adjacent areas, of the pouch.

In an embodiment, the first and a second elongated plates determine a track of adjustable width.

Preferably, no other slip surfaces with jet nozzles to project pressurized fluid is arranged between the first and the second elongated plates.

Being the pouch conveyor supported in a chassis, it is envisaged that at least one of the first or the second plate is mounted on the chassis, in fluid communication with a source of the pressurized fluid, with movement capacity with respect to the other of the first or the second plate without losing parallelism with the aforementioned other of the first or the second plate.

In an embodiment, the first and the second plate are mounted on the chassis with movement capacity.

Advantageously, the means for supplying a stream of pressurized fluid upon which the conveyed separated pouch lies are configured to supply and supplies the stream in a continuous fashion all along the length dimension of the first and the second plates.

In an embodiment, each first and second elongated plates has or is joined to a lateral, essentially vertical, wing. These wings serve to accommodate and guide the separated pouch, the lateral edges of which are guided by the said lateral flanges during the conveying of the pouch.

In an embodiment, between at least one of the first or the second plate and the lateral wing adjacent thereto there is formed or determined a channel, intended to receive or to house, at least partially, a spout of a conveyed pouch provided with a corner spout.

In an embodiment, a lateral wing can be removably coupled to an adjacent plate, here the first or the second plate.

The invention also envisages that a lateral wing be moveable coupled with respect to an adjacent plate, here to the first or the second plate.

In an embodiment, the pick up area has a pouch detection means.

The pouch detection means comprise a central rib with a plural number of sensors, the rib being arranged in the direction of a length dimension of the pouch as defined when the pouch properly rests against the positioning stopper of the pick up area, the sensors being distributed along the rib.

In an embodiment, the positioning stopper is a moveable positioning stopper.

The moveable positioning stopper can be movable between a pouch retention position and a pouch release position able to produce the pouch to be propelled out of the pouch conveyor by the same stream of pressurized fluid that maintained the separated pouch against the positioning stopper when the positioning stopper adopted the retention position.

In an embodiment, the moveable positioning stopper is driven as a function of the signals generated by the sensors of the pouch detection means.

According to another aspect of the invention, a method to feed a pick up area of a pouch magazine with a pouch separated from a stack of pouches is also claimed, the method employing the Coanda effect to propel the separated pouch towards the said pick up area and to maintain the conveyed pouch against a positioning stopper provided in the said pick up area, the Coanda effect acting over areas of the pouch next to or including opposite edges, preferably opposite lateral edges, of the pouch.

A method to sequentially supply empty pouches to a packaging machine can comprise sequentially feeding a pick up area of pouch magazine with empty pouches; and sequentially picking-up the empty pouches from the pick up area and transferring them to the packaging machine, the method also comprising the supplying of a stream of pressurized fluid upon which the pouches fed to the pick up area lies, said means for supplying a stream being configured to applying sufficient Coanda effect forces to said stream to propel the pouches to the pick up area and to maintain the pouches against a positioning stopper of the pick up area, wherein the supplying of the stream is a continuous supplying.

DETAILED DESCRIPTION OF THE INVENTION

Figure 1:
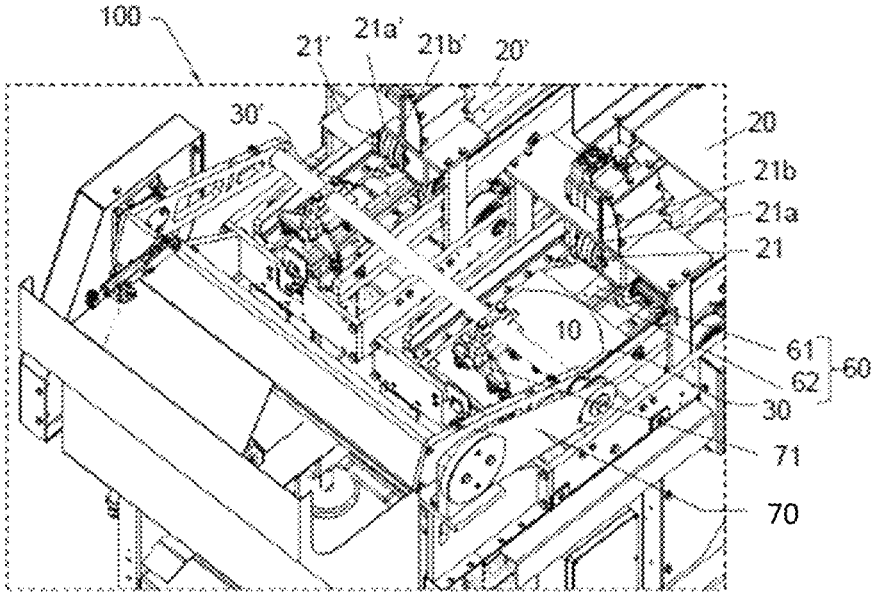
FIG. 1, is a perspective view of a part of a pouch magazine according to the invention.
Figure 2:
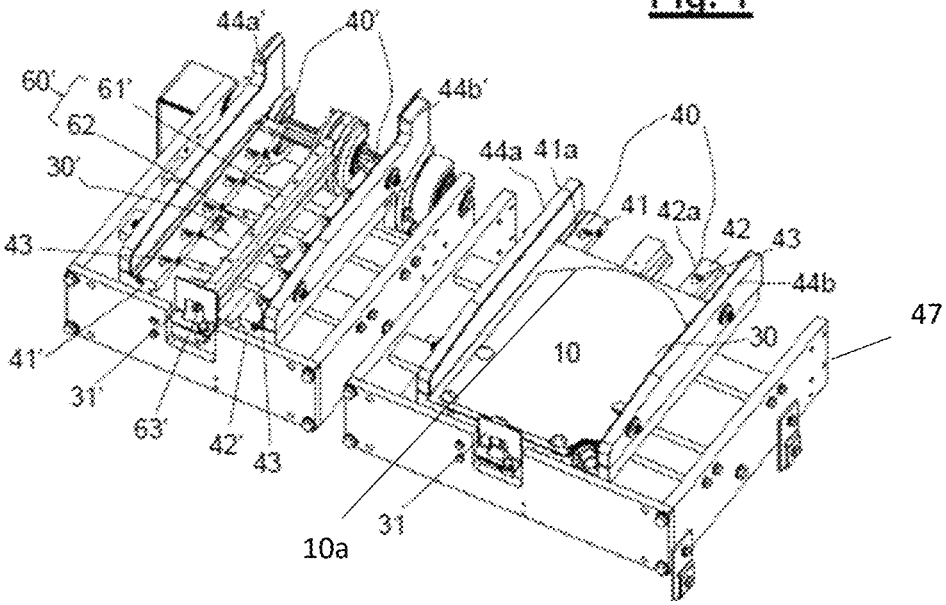
FIG. 2, shows the pick up area of the pouch magazine of FIG. 1 devoid of some components to facilitate the comprehension of the drawing.

The invention is exemplified by the pouch magazine 100 of FIGS. 1 and 2.

In this specific example, the pouch magazine 100 comprises a set of two racks 20, 20' to accommodate respective stacks (not visible) of empty pre-made containers, particularly, but not exclusively, in the form of empty pouches.

Naturally, the invention envisages a pouch magazine 100 with a number of racks different of two, including one rack.

The two racks 20, 20' of the pouch magazine 100 that exemplifies the invention are themself known. They comprise each a conveyor belt and lateral guide plates installed on the left and right sides of the conveyor belt. Over each conveyor belt a stack of pouches are accommodated so that their mouths look down and forward, this is, the pouches in the stack are slightly tilted backwards.

The lateral edges of the bags are guided by the lateral guide plates, and the pouches are conveyed forward (toward left side in FIG. 1) so that a pouch separating means 21, 21', that acts on the free part of the first pouch, that is not overlapped behind by the pouch that follows it, separate the first pouch from the stack and quickly feeds it forward, sending it to a pouch pick up area 30, 30'. As shown in FIG. 2, in one embodiment, opposite lateral edges can be stiffened by the effect of a welding joint 10*a* along the edges by fusion of the materials that make up the pouch.

In the example, the separating means 21, 21' each comprises of a set of two jointly driven drag belts 21*a*, 21*b*; 21*a*', 21*b*', actuated in motion so that the belts of a same set, by friction with the cited free part of the first pouch, pushes the first pouch to feed it forward.

In the drawings, a separated first pouch 10 is illustrated, particularly arranged in the pick up area 30.

The pouch magazine 100 comprises movable transfer means 70 configured to, following a reciprocating motion, take separated pouches waiting in the pick up area 30, 30', transport and deliver them to the packaging machine (not represented) and move back to take a new pair of pouches to be delivered to the packaging machine in a subsequent stroke of the packaging machine.

In conventional way, the movable transfer means 70 in the example of FIG. 1 comprises a set of parallel rotating arms between which extends a tool-carrying bridge, in the example carrying a number of two tools 71 in correspondence with the number of two pick up areas. The aforementioned tool-carrying bridge is rotatable around its longitudinal axis and with respect to the arms, so that the picked-up pouches can be translated along the axes of rotation of the arms and rotated around the longitudinal axis of the tool-carrying bridge while they are being moved to the packaging machine.

In the example of FIG. 1, the pick up areas 30, 30' are longitudinally aligned with an associated rack 20, 20'. The invention envisages, however, other embodiments.

The pouch pick up areas 30, 30' are better showed in the FIG. 2.

According to the present invention, a pouch pick up area 30, 30' is equipped with a pouch conveyor to convey the separated first pouch 10 of the stack up to a positioning stopper with which the said pick up area 30, 30' is provided with.

In the specific example of FIG. 2, the two pick up areas 30, 30' are each equipped with a corresponding conveyor 40, 40' to convey the separated first pouch 10 of a stack up to a positioning stopper 31, 31' with which the said pick up areas 30, 30' are provided with.

The positioning stoppers 31, 31' will be described later in more detail. However, it is worth noticing that although in the example of FIG. 2 they are similar, it is envisaged that when a pouch magazine 100 has more than one pick up area 30, 30', the stoppers 31, 31' for each pick up area 30, 30' can be different, each according to the peculiarities of the pouch and/or the target position at which the pouch has to remain in the pick up area 30, 30'.

With regards to the pouch conveyors 40, 40', in the example of FIG. 2, each pouch conveyor 40, 40' has means for supplying a stream of pressurized fluid upon which the conveyed first pouch 100 will lay, said means for supplying a stream being configured to apply sufficient Coanda effect forces to said stream to propel the separated first pouch 100 to the distal end of the pick up area 30, 30' and to maintain the separated pouch against the positioning stopper 31, 31' attenuating or avoiding rebound.

The supply of the stream can be a continuous supply. This is to say, it is not necessary to interrupt the blowing each time a new pouch is conveyed or between pouches to be conveyed.

In the example of FIG. 2, each pouch conveyor 40, 40' extends all along the pick up area 30, 30'.

In the example of FIG. 2, each pouch conveyor 40, 40' comprises a first and a second elongated plates 41, 42; 41', 42' defining respective slip surfaces 41*a*, 42*a*, flat, with jet nozzles 43 to project the pressurized fluid that propels the separated pouch.

The nozzles 43 are configured to inject air tangentially on the slip surfaces 41*a*, 42*a* producing a laminar flow along the said slip surfaces 41*a*, 42*a* to produce the Coanda effect.

The nozzles 43 are connected to a source of a compressed fluid, for example to a common source of compressed fluid. The fluid in question can be air.

For example, the first and the second elongated plates 41, 42; 41', 42' can determine respective cavities in communication with source of pressurized fluid.

The nozzles 43 can be equidistant. However, other distributions are possible. The number of nozzles 43 can vary depending on the dimensions of the pick up area 30, 30' or the distance between the pick up area 30, 30' and the separating means 21, 21'.

In any case, the example of FIGS. 2, each pair of first and the second elongated plates 41, 42; 41', 42' determine a track of adjustable width.

For example, being a pouch conveyor supported in a chassis 47, at least one of the first or the second plate 41, 42; 41', 42' is mounted on the chassis, in fluid communication with a source of the pressurized fluid, with movement capacity with respect to the other of the first or the second plate 41, 42; 41', 42' without losing parallelism with the other of the first or the second plate 41, 42; 41', 42'.

In the example of FIG. 2, the elongated first and second plates 41, 42; 41', 42' are straight, determining a straight path, aligned with the longitudinal dimension of the racks 20, 20'.

In other embodiments, a first and second elongated plates 41, 42; 41', 42' can determine a curved track or a track with curved sections so that a pick up area 30, 30' is not necessarily longitudinally aligned with an associated rack 20, 20'.

In either case, the plates are meant to propel the pouch from their opposite side edges.

In the example of FIG. 2, each first and second elongated plates 41, 42; 41', 42' are completed with a lateral, essentially vertical, wing 44*a*, 44*b*; 44*a*', 44*b*'. These wings 44*a*, 44*b*; 44*a*', 44*b*' serve to accommodate and guide the separated pouch, the lateral edges of which are guided by the said lateral wings. In this sense and in reference to the FIG. 2, the lateral edges of the pouch 10 are guided by the lateral wings 44*a*, 44*b*.

The invention envisages that a lateral wing 44*a*, 44*b*; 44*a*', 44*b*' be removably coupled to a plate.

The invention also envisages that a lateral wing 44*a*, 44*b*; 44*a*', 44*b*' be moveable coupled with respect to a plate.

Although not shown, the invention also envisages that at least a further plate, arranged between the first and the second elongated plates meant to propel the pouch from their opposite side edges, be arranged to propel a pouch also from a central area thereof.

Figure 3:
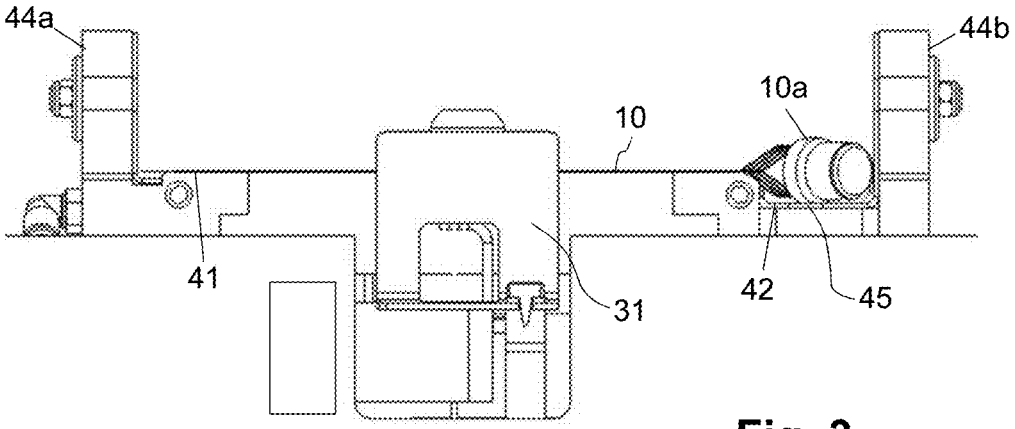
FIG. 3 shows a simplified frontal view of the pick up area of a pouch magazine according to the invention.

FIG. 3 serves to better understand the advantages of these embodiments of the invention.

Specifically, FIG. 3 shows an embodiment wherein the right-hand wing 44*b* is attached to the second plate 42 (the right-hand plate) determining a sort of a channel 45, to accommodate a spout 10*a* of the pouch 10, being the pouch of the type provided with a corner spout. In this way, the presence of a spout 10*a* does not impede the pouch 10 to slide properly along the first and the second plates 41, 42 over the slip surfaces 41*a*, 42*a* with jet nozzles 43. This embodiment is practiced in the right-hand pick up area 30 of the pouch magazine 100 as illustrated in FIG. 2.

In this same pouch magazine 100, the right-hand wing 44*b*' corresponding to the pouch conveyor 40' has a different profile or configuration, specifically intended to convey a pouch (not illustrated) devoid of corner spout. Therefore, in this case there is not a channel intended to accommodate a spout.

As previously mentioned, it is envisaged that the operator can have a set of wings to choose the appropriate one to be fixed to a plate; or to provide for a mechanical coupling between the lateral wing to the plate such that the relative position between them can be changed, to name two possible alternatives.

According to an embodiment, a pick up area can be provided also with detection means, to ensure that a pouch is correctly arranged or placed in the pick up area.

In the exemplary embodiment of the invention, each pick up area 30, 30' of the pouch magazine 100 has a pouch detection means 60, 60'.

A detection means is implemented, in the examples, per via of a central rib 61, 61' with a plural number of sensors 62, at least one being a positioning sensor adjacent the positioning stopper.

The rib 61, 61' is therefore, preferably, arranged in the direction of the height dimension of a pouch, this is, so that it extends essentially longitudinal with respect to a pouch when the pouch is in a pick up area 30, 30' and against the respective positioning stopper 31, 31'.

The sensors 62 can be distributed along the rib 61, 61'.

The sensors 62 can be, for example, equidistantly distributed.

A sensor may be arranged moveable along the associated rib, so that its relative position with regards to the rib can be changed.

A sensor 62 can be, for example, a photoelectric sensor or a fiber-optic sensor.

When a pouch is to be correctly arranged against a positioning stopper 31, 31' of a pick up area 30, 30', the positioning sensor adjacent or next to the positioning stopper 31, 31' will be covered by the pouch.

In an embodiment of the invention, apart from the positioning sensor there are a plural number of other sensors 62. The number of sensors 62 that must be covered will be dictated by the format of the pouch, in this exemplary case based on the height dimension of the pouch. Consequently, for each pouch the number of sensors 62 that should be covered will be known in advance. The non-correspondence between the number of sensors 62 that theoretically should be covered with the actual number of sensors 62 that are covered, in this case that generate or return the signal corresponding to being covered, can trigger an alert signal and/or can trigger other actions.

A possible action can be one that operates the positioning stopper 30, 30' against which a pouch should be resting.

Accordingly, in an embodiment of the invention the positioning or positioning stoppers 31, 31' can be moveable positioning stoppers, driven in function of a signal generated by the detection means.

In the exemplary embodiment of the invention, the positioning stoppers 31, 31' are moveable between a retention position and a release position. A retention position is one that impedes a pouch to move further, the pouch resting against the positioning stopper 31, 31'; and a release position is one that does not prevent a pouch, subjected to the Coanda effect, to keep being pushed forward. In this second case the pouch can end up in a reject tray.

An action of operating a positioning stopper 31 or 31' towards its release position can be accompanied or complemented by the action of temporarily increasing the fluid flow pressure of the pouch conveyor, to more quickly spit the rejected pouch out of a pick up area.

This increase, for example, can be of the order of more than 500%, preferably more than 600%.

This means that, if in an embodiment of the invention the fluid pressure used to convey the pouches is close to, without reaching, 1 bar, the rejection pressure can be of around 6 bar.

In another embodiment of the invention, apart from the positioning sensor there is another sensor 62, in a rib 61 or 61', and a feeding sensor, arranged next to the pouch separating means 21 or 21' and supported in a fixed part of the magazine so that its detection window focuses on the free face of the first pouch in the stack.

In this case, the returned signals of these sensors can trigger further actions, apart from operating the positioning stopper 30, 30', such as actions related to the operating of the separating means 21 or 21'.

In a further embodiment, a spot detection sensor 63' can be arranged in a distal area of the channel 45, with a detection window covering either the space a spout is deemed to occupy or the empty space a pouch with a corner spout is deemed to leave uncovered.

In an embodiment, a sensor, such as the positioning sensor or a spout detection sensor, can be or comprise an image capturing device. The captured image can then be compared with a digitally stored image to proceed accordingly as a function of the comparison. In this case, it can be detected not only a lack of precision in the feeding positioning of a pouch in the pick up area, but also that the stack of pouches has been loaded incorrectly in the rack, for example, in reverse (with the spouts on the wrong side).

The invention claimed is:

1. A pouch magazine to sequentially supply empty pouches to a packaging machine, the magazine comprising:

a rack configured to accommodate a stack of empty pouches;

a pouch pick-up area having a positioning stopper;

a pouch separating means configured to separate a first pouch from the stack of empty pouches in order to send the first pouch to the pouch pick-up area; and a pouch conveyor configured to convey the separated first pouch to the positioning stopper of the pouch pick-up area, wherein said pouch conveyor having means for supplying a stream of pressurized fluid upon which the conveyed separated first pouch lies, said means for supplying the stream of pressurized fluid configured to create sufficient Coanda effect forces to the stream of pressurized fluid to propel the separated first pouch to the pouch pick-up area and to maintain the separated first pouch against the positioning stopper of the pouch pick-up area;

wherein the pouch conveyor comprises a first elongated plate spaced apart from a second elongated plate, wherein said means for supplying the stream of pressurized fluid comprising jet nozzles; and wherein each of the first elongated plate and the second elongated plate comprising respective slip surfaces provided with the jet nozzles configured to project the stream of pressurized fluid onto corresponding opposing areas of the separated first pouch;

wherein the means for supplying the stream of pressurized fluid upon which the separated first pouch lies are configured to supply the stream of pressurized fluid in a continuous fashion all along the length dimension of the first elongated plate and the second elongated plate; and wherein each of the first elongated plate and the second elongated plate has or is joined to a lateral, essentially vertical, wing dimensioned to guide the separated first pouch during the conveying of the separated first pouch, and wherein between at least one of the first elongated plate or the second elongated plate and the lateral wing adjacent thereto is a channel, configured to receive or to house, at least partially, a spout of the separated first pouch.

2. The pouch magazine according to claim 1, wherein that the first elongated plate and the second elongated plate determine a track of adjustable width.

3. The pouch magazine according to claim 2, wherein the pouch conveyor is supported in a chassis and at least one of the first elongated plate or the second elongated plate is mounted on the chassis, with movement capacity with respect to the other of the first elongated plate or the second elongated plate without losing parallelism with the other of the first elongated plate or the second elongated plate.

4. The pouch magazine according to claim 1, wherein the pouch pick-up area is longitudinally aligned with the rack.

5. The pouch magazine according to claim 1, wherein the pouch conveyor extends all along the pouch pick-up area.

6. A pouch magazine to sequentially supply empty pouches to a packaging machine, the magazine comprising:

a rack configured to accommodate a stack of empty pouches;

a pouch pick-up area having a positioning stopper;

a pouch separating means configured to separate a first pouch from the stack of empty pouches in order to send the first pouch to the pouch pick-up area; and a pouch conveyor configured to convey the separated first pouch to the positioning stopper of the pouch pick-up area, wherein said pouch conveyor having means for supplying a stream of pressurized fluid upon which the conveyed separated first pouch lies, said means for supplying the stream of pressurized fluid configured to create sufficient Coanda effect forces to the stream of pressurized fluid to propel the separated first pouch to the pouch pick-up area and to maintain the separated first pouch against the positioning stopper of the pouch pick-up area;

wherein the pouch pick-up area has a pouch detection means having a central rib with a plural number of sensors, the rib being arranged in a direction of a height dimension of the pouch as defined when the separated first pouch properly rests against the positioning stopper of the pouch pick-up area, and wherein the sensors are distributed along the rib.

7. The pouch magazine according to claim 6, wherein at least one sensor is one of a photoelectric sensor or a fiber-optic sensor.

8. A pouch magazine to sequentially supply empty pouches to a packaging machine, the magazine comprising:

a rack configured to accommodate a stack of empty pouches;

a pouch pick-up area having a positioning stopper;

a pouch separating means configured to separate a first pouch from the stack of empty pouches in order to send the first pouch to the pouch pick-up area; and a pouch conveyor configured to convey the separated first pouch to the positioning stopper of the pouch pick-up area, wherein said pouch conveyor having means for supplying a stream of pressurized fluid upon which the conveyed separated first pouch lies, said means for supplying the stream of pressurized fluid configured to create sufficient Coanda effect forces to the stream of pressurized fluid to propel the separated first pouch to the pouch pick-up area and to maintain the separated first pouch against the positioning stopper of the pouch pick-up area;

wherein the positioning stopper is a moveable positioning stopper, moveable between a pouch retention position and a pouch release position able to produce the separated first pouch to be propelled out of the pouch conveyor by the stream of pressurized fluid that maintained the separated first pouch against the positioning stopper when the positioning stopper adopted the retention position.

9. The pouch magazine according to claim 8, wherein the moveable positioning stopper is driven as a function of signals generated by the sensors of the pouch detection means.

* * * * *